US005379730A

United States Patent [19]

Schaeffler

[11] Patent Number: 5,379,730

[45] Date of Patent: Jan. 10, 1995

[54] CUP-SHAPED VALVE TAPPET

[75] Inventor: E. H. Georg Schaeffler, Herzogenaurach, Germany

[73] Assignee: Ina Walziager Schaeffler KG, Germany

[21] Appl. No.: 275,957

[22] Filed: Jul. 15, 1994

[30] Foreign Application Priority Data

Jul. 30, 1993 [DE] Germany ..... 4325610

[51] Int. Cl.[6] ..... F01L 1/24; F01L 1/14

[52] U.S. Cl. ..... 123/90.55; 123/90.51; 74/569

[58] Field of Search ..... 123/90.48, 90.49, 90.51, 123/90.55; 74/569

[56] References Cited

U.S. PATENT DOCUMENTS

| | | | |
|---|---|---|---|
| 4,437,439 | 3/1984 | Speil | 123/90.55 |
| 4,635,593 | 1/1987 | Kodama | 123/90.55 |
| 4,648,360 | 3/1987 | Schaeffler | 123/90.55 |
| 4,802,448 | 2/1989 | Ableitner | 123/90.55 |
| 4,876,997 | 10/1989 | Zorn et al. | 123/90.55 |
| 4,951,619 | 8/1990 | Schaeffler | 123/90.55 |

*Primary Examiner*—Andrew M. Dolinar
*Assistant Examiner*—Weilun Lo
*Attorney, Agent, or Firm*—Bierman and Muserlian

[57] ABSTRACT

A cup-shaped valve tappet (1,25) for actuating a valve of an internal combustion engine, comprising a cylindrical jacket (2,26) closed at one end by a bottom (3,27) and on whose outer peripheral surface (17,43) a circumferential groove (18,44) is formed by non-cutting shaping, while on an inner peripheral surface (5,37) of said cylindrical jacket a sheet metal cylinder (4,39) is guided substantially without play, said valve tappet further comprising a guide sleeve (7,35) in which a hydraulic clearance compensation element (8,34) is received, characterized in that the sheet metal cylinder (4,39) extends at least up to a region of the jacket (2,26) comprising the circumferential groove (18,44) while a bead (19,46) formed by non-cutting shaping on the inner peripheral surface (5,37) of the jacket (2,26) bears against a circumferential groove (20,48) of the sheet metal cylinder (4,39).

13 Claims, 2 Drawing Sheets

Figure 3:
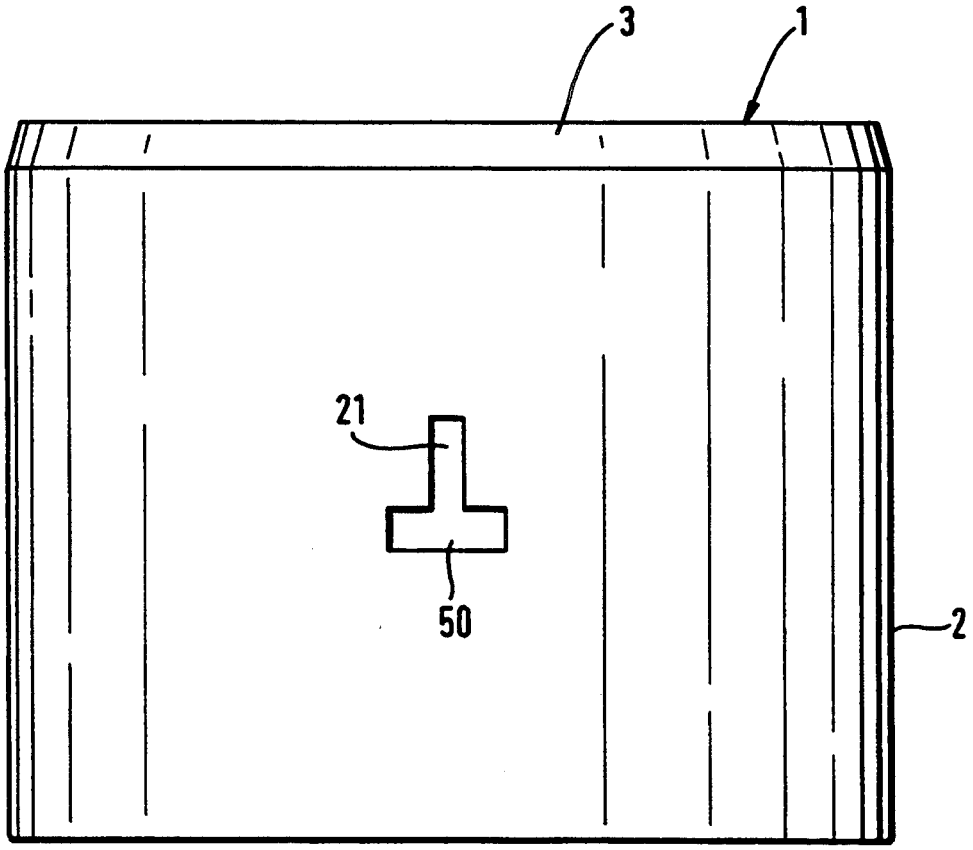

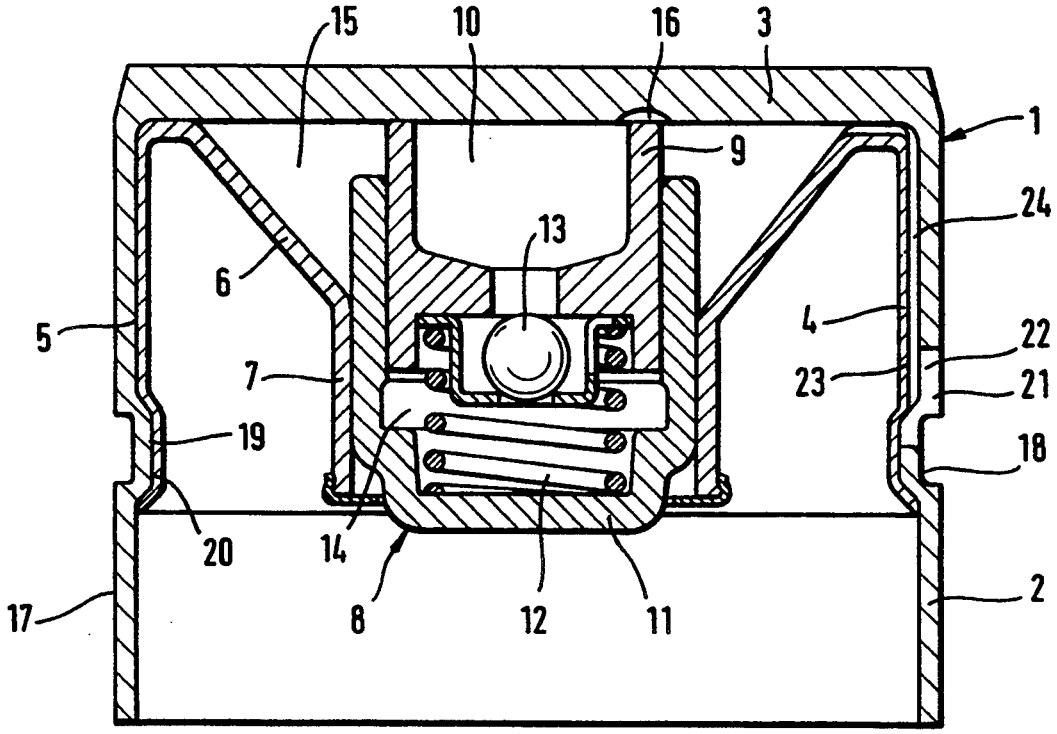
Fig. 1
Fig. 2
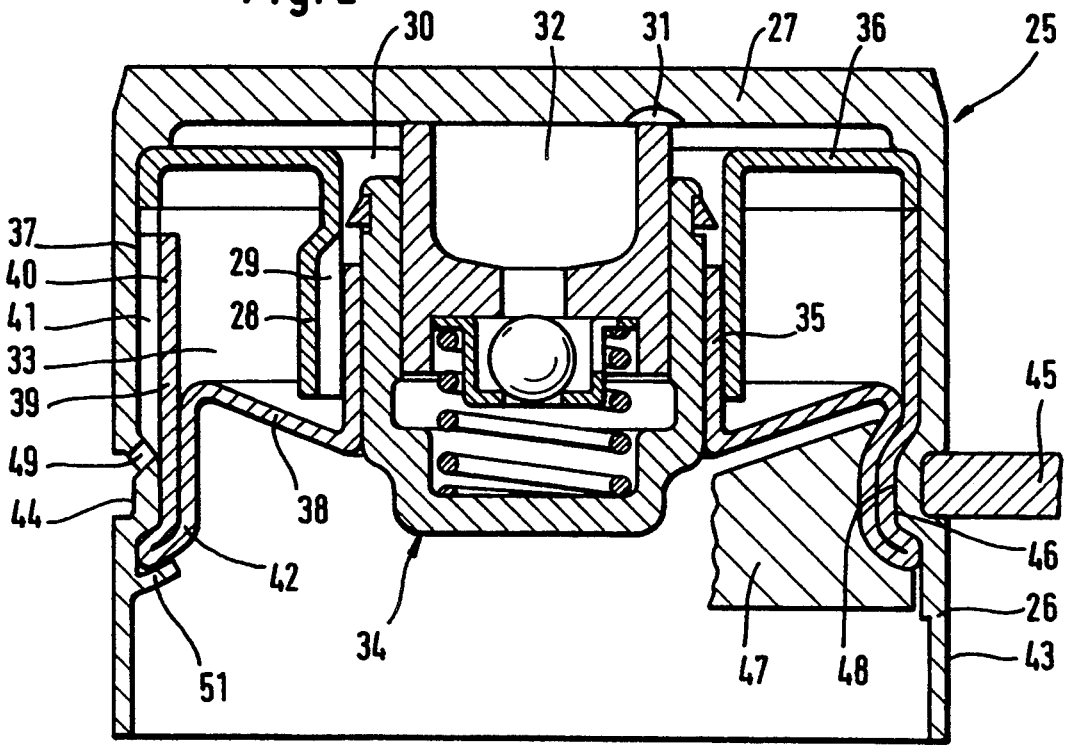

CUP-SHAPED VALVE TAPPET

STATE OF THE ART

A cup-shaped valve tappet for actuating a valve of an internal combustion engine, comprising a cylindrical jacket which is closed at one end by a bottom and on whose outer peripheral surface a circumferential groove is formed by non-cutting shaping, while on an inner peripheral surface of said cylindrical jacket, a sheet metal cylinder is guided substantially without play, said valve tappet further comprising a guide sleeve which is concentric with the jacket and receives a hydraulic clearance compensation element is known from DE-A-3,412,175. The sheet metal cylinder arranged in this valve tappet comprises a radially projecting rim by which the cylinder bears on one side against a shoulder of the inner peripheral surface of the jacket (FIG. 2). At the end of the sheet metal cylinder opposite this shoulder, a circumferential groove is made in the jacket by non-cutting shaping, i.e. by roller-forming, which results in a corresponding deformation of the jacket on the inner peripheral surface thereof.

In this way, the radial collar of the sheet metal cylinder is fixed in the axial direction between the shoulder and the roller-formed recess. This type of fixing of the sheet metal cylinder requires special measures for shaping the sheet metal cylinder and configuring the inner peripheral surface of the jacket. For this purpose, the jacket has to have differing wall thicknesses so that an appropriate shoulder can be formed, and the sheet metal cylinder has to be crimped to form the radial rim because only with this type of rim is a fixing between the shoulder and a roller-formed bead possible. Finally, the jacket of such a valve tappet is relatively thick-walled because of its regions of varying wall thickness, and this leads to an undesired increase in weight of the valve tappet.

OBJECTS OF THE INVENTION

It is an object of the invention to provide a valve tappet of the pre-cited type avoiding the mentioned disadvantages and to create a simple and inexpensive fixing of the sheet metal cylinder to the jacket of the cup-shaped valve tappet.

This and other objects and advantages of the invention will become obvious from the following detailed description.

THE INVENTION

The novel cup-shaped valve tappet of the invention for actuating a valve of an internal combustion engine, comprising a cylindrical jacket (2,26) closed at one end by a bottom (3,27) and on whose outer peripheral surface (17,43) a circumferential groove (18,44) is formed by non-cutting shaping, while on an inner peripheral surface (5,37) of said cylindrical jacket a sheet metal cylinder (4,39) is guided substantially without play, said valve tappet further comprising a guide sleeve (7,35) in which a hydraulic clearance compensation element (8,34) is received, is characterized in that the sheet metal cylinder (4,39) extends at least up to a region of the jacket (2,26) comprising the circumferential groove (18,44) while a bead (19,46) formed by non-cutting shaping on the inner peripheral surface (5,37) of the jacket (2,26) bears against a circumferential groove (20,48) of the sheet metal cylinder (4,39).

The invention achieves this object by the fact that the sheet metal cylinder extends at least up to a region of the jacket comprising the circumferential groove while, at the same time, a roller-formed bead on the inner peripheral surface of the jacket bears against a circumferential groove of the sheet metal cylinder. During assembly, the sheet metal cylinder is inserted into the cylindrical jacket until it comes into a pre-determined position in which it extends at least partially over the region in which the jacket is to be subsequently provided with a circumferential groove. In a modification, the circumferential groove and an axial fixing of the sheet metal cylinder can be obtained simultaneously by positioning an inner roller-forming tool as a counter stay at a distance from the inner peripheral surface of the sheet metal cylinder and chiplessly deforming the jacket together with the sheet metal cylinder by means of an outer roller-forming tool until the counter stay is contacted.

The common roller-forming of these two components assures a secure axial fixing of the sheet metal cylinder in the cylindrical jacket and, advantageously, is suited as a joining method in large-scale production of the valve tappet wherein the roller-forming can be done in such a way that the circumferential groove of the sheet metal cylinder bears in a leak-tight manner against the bead. Besides this, the jacket can be made very thin-walled because no shoulder is required on its inner peripheral surface for fixing the sheet metal cylinder. Alternatively, the sheet metal cylinder can be provided prior to assembly with a rolled-in circumferential groove into which the bead of the jacket can then be made to engage by appropriate deformation. It is further possible to make the sheet metal cylinder comprising the circumferential groove so as to be radially resilient, and have it lock with the bead.

In another modification, the sheet metal cylinder forms a common component with a radially inwards extending flange and with the guide sleeve into which this flange merges and which is concentric with the jacket. The sheet metal cylinder extends at least sectionwise up to the bottom, and the flange, preferably shaped as a truncated cone, delimits together with the bottom and an inner and outer piston of the clearance compensation element, an annular oil reservoir. In this way, the guide sleeve is supported on the bottom of the tappet and guided on the part of the inner peripheral surface of the jacket comprised between the bead and the bottom. The annular oil reservoir formed in this way has a relatively small volume so that the moving mass of the valve tappet is very small on the whole and the oil reservoir is rapidly refilled after a longer standstill phase of the internal combustion engine and an eventual oil loss from the oil reservoir.

There exists further the possibility of making the flange in accordance with generic prior art, in which case, the flange extends, parallel or at a slant to the bottom, at a distance therefrom, and carries a guide sleeve extending towards or away from the bottom. Further, the transition from the sheet metal cylinder to the flange can have a relatively large radius so that the flange is then partially cylindrical in shape.

A longitudinally extending bead may be stamped in the sheet metal cylinder and, together with the inner peripheral surface of the jacket, forms an oil duct. This oil duct is connected with a radial oil supply bore of the jacket arranged, according to the invention, in the circumferential groove of the jacket, while the bead extends into the circumferential groove of the sheet metal cylinder. Compared with the prior art, this configuration for supplying oil to the clearance compensation element has the advantage that, apart from the machining of the oil supply bore and the subsequent roller-forming of the jacket and the sheet metal cylinder, no further machining or working of the valve tappet is required. However, it must be assured that the oil supply bore which extends preferably at a slant in the roller-formed circumferential groove, guarantees a reliable transfer of oil from the lubricating circuit of the internal combustion engine to the oil duct.

According to another feature, during the simultaneous roller-forming of the jacket and the sheet metal cylinder, an inner roller-forming tool only engages the lower part of the region where the circumferential groove is to be formed so that the resulting bead has a flat transition region or large transition radius at its upper end. Thus, the inner roller-forming tool supports the sheet metal cylinder only sectionwise with respect to the outer roller-forming tool so that the bead has small transition radii at its lower end and large transition radii or flattenings at its upper end whereby it is guaranteed that the inclined oil supply bore registers with the oil duct.

By reason of the common roller-forming of the sheet metal cylinder and the jacket, the latter can be made very thin-walled, the ratio between the wall thicknesses of the jacket and the bottom being, approximately 1:2.5 to 2.8. The jacket can have a wall thickness of less than 1 mm, preferably 0.8 mm. This small wall thickness of the jacket leads to considerable additional reduction in the weight of the entire cup tappet, one of the essential prerequisites for such a thin-walled jacket being that the sheet metal cylinder is fixed in the jacket in the manner provided by the invention.

A development of a cup-shaped valve tappet having an axial slot punched into the jacket and starting from the circumferential groove is a reliable alternative for the transfer of oil from the circumferential groove into the oil supply bore and from there into the oil duct. In the region of the circumferential groove, the axial slot made prior to the roller-forming comprises a widening in the peripheral direction and extends up to an oil canal formed by a bead in the sheet metal cylinder. This widening which can be configured so that prior to the roller-forming, the axial slot has a T-shaped contour, is intended to assure that an adequate cross-section for the transfer of oil from the circumferential groove into the axial slot remains in spite of the local deformation caused by the roller-forming.

A secure fixing of the sheet metal cylinder is guaranteed by additionally providing, at least sectionwise, a swaging at the lower end of the sheet metal cylinder for reasons of safety.

REFERRING NOW TO THE DRAWINGS

FIG. 1 is a longitudinal cross-section of a cup-shaped valve tappet in which a sheet metal cylinder formed in one piece with a flange and a guide sleeve is arranged, FIG. 2 is a longitudinal cross-section of a cup-shaped valve tappet in which a sheet metal cylinder arranged therein prevents an emptying of an annular oil reservoir, an additional swaging being shown on one side of a central construction line, and FIG. 3 is a side view of the valve tappet of FIG. 1 having a cross-slot before the circumferential groove is made.

FIG. 1 shows a cup-shaped valve tappet, identified at 1, which comprises a cylindrical jacket 2 and can be inserted into a bore, not shown, of a cylinder head of a internal combustion engine. The cylindrical jacket 2 is closed at one end by a bottom 3 whose outer surface is in sliding contact with a cam of a camshaft, not shown, during the operation of the internal combustion engine.

Inside the cup-shaped valve tappet 1, there is arranged a sheet metal cylinder 4 which bears substantially without play against an inner peripheral surface 5 of the jacket 2 while extending up to the bottom 3. This sheet metal cylinder 4 merges at first with a flange 6 in the shape of a truncated cone and then with a guide sleeve 7. Inside this guide sleeve 7, which is concentric with the jacket 2, is lodged a hydraulic clearance compensation element 8 comprised essentially of an inner piston 9 which, together with the bottom 3 forms a central oil reservoir 10, a hollow piston 11, a spring 12 and a ball valve 13. Together with the inner piston 9 and the ball valve 13, the hollow piston 11 encloses a pressure chamber 14 and bears by an end face against an end of a valve stem of an engine valve, not represented. The flange 6, the hollow piston 11, the inner piston 9 and the bottom 3 delimit an annular oil reservoir 15 which communicates via a recess 16 in the bottom 3 with the central oil reservoir 10.

On an outer peripheral surface 17, the jacket 2 comprises a roller formed circumferential groove 18. Oil from a lubricating oil circuit is fed through bores, not represented, into the bore of the cylinder head, not represented, in which the cup-shaped valve tappet 1 is inserted. As soon as the oil feeding bores register with the circumferential groove 18, oil can be transferred into the annular oil reservoir 15. As can be further seen in FIG. 1, a bead 19 resulting from the roller-forming of the circumferential groove 18 is formed on the inner peripheral surface 5 of the jacket 2. This bead 19 bears in a leak-tight manner against a circumferential groove 20 of the sheet metal cylinder 4.

Both the cylindrical jacket 2 and the sheet metal cylinder 4 can be made very thin-walled without requiring a finishing treatment after roller-forming as is necessary, for example, in welding or soldering. An axial slot 21 made by punching leads from the circumferential groove 18 to an oil duct 24. At its end adjacent the oil duct 24, this axial, punched slot 21, which is partially covered by the circumferential groove 20 of the sheet metal cylinder 4, forms an oil supply opening 22. The sheet metal cylinder 4 comprises a longitudinally extending bead 23 which, together with the inner peripheral surface 5, delimits the oil duct 24. This bead 23 is formed by lateral pressing-in after the component comprised of the sheet metal cylinder 4, the flange 6 and the guide sleeve 7 has been made by deep-drawing. The special configuration of the axial slot 21 will be discussed in connection with FIG. 3.

FIG. 2 is a simplified representation of another example of an embodiment of the invention. A cup-shaped valve tappet 25, represented in longitudinal cross-section, likewise comprises a cylindrical jacket 26 and a bottom 27. A sleeve 28 which supplies oil from an annular oil reservoir 33 via a longitudinal duct 29 to an annular space 30 and via a recess 31 in the bottom 27 to a central oil reservoir 32, is inserted into the valve tappet 25. The sleeve 28 further has the important function of guiding a clearance compensation element 34 in the longitudinal direction with the help of a guide sleeve 35 inserted into the sleeve 28. The configuration of the clearance compensation element 34 corresponds essentially to that of the clearance compensation element 8 of FIG. 1. At its end adjacent the bottom 27, the sleeve 28 merges with a flange 36 which extends up to an inner peripheral surface 37 of the jacket 26 on which it is guided. The guide sleeve 35 inserted into the sleeve 28 forms a common component with an annular flange 38 and a sheet metal cylinder 39. This sheet metal cylinder 39 is inserted together with the flange 38 into the jacket 26 and bears without play against the inner peripheral surface 37 thereof except at one peripheral point where an oil duct 41 is formed by a bead 40. The transition from the flange 38 to the sheet metal cylinder 39 is a doubled-over portion 42 which is made before the component comprised of the sheet metal cylinder 39, the annular flange 38 and the guide sleeve 35 is inserted.

On its outer peripheral surface 43, the jacket 26 comprises a circumferential groove 44 which is made by roller-forming, for example by means of the outer roller-forming tool 45 represented schematically in part. As a result of the roller-forming of the circumferential groove 44, a bead 46 is formed on the inner peripheral surface 37 of the jacket 26. Since the doubled-over portion 42 of the sheet metal cylinder 39 bears against the region in which the bead 46 is located and since it is fixed on the inside by a counter stay during the roller-forming operation, a circumferential groove 48 is likewise formed in this portion of the sheet metal cylinder and bears in a leak-tight manner against the bead 46. An inclined oil supply bore 49 starts from the circumferential groove 44 of the jacket 26 and is in communication with the oil duct 41.

As can be seen from FIG. 2, the counter stay 47 is configured so that it does not engage the sheet metal cylinder over the entire width of the bead 46 in the upper region. By this, a relatively flat shape is obtained in the upper region of the sheet metal cylinder 39 by the roller-forming operation so that oil transfer between the oil supply bore 49 and the oil duct 41 is assured. On the one hand, the sheet metal cylinder comprising the bead 40 supports the flange 36 on one end face and carries, as already mentioned, the guide sleeve 35 with the help of the annular flange 38 while, on the other hand, the bead 40 of the sheet metal cylinder forms the oil duct 41, which arrangement reliably prevents an emptying of the annular oil reservoir 33. On the left-hand side of a central construction line, an embodiment of this valve tappet 25 is shown in which an additional swaging 51 is provided at the lower end of the sheet metal cylinder 39. This swaging 51, which is also possible in the example of the embodiment of FIG. 1, can be made sectionwise or be continuous over the entire periphery and is located on the other side of the end of the sheet metal cylinder as the bead 46. Alternatively, the sheet metal cylinders of the embodiments of FIGS. 1 and 2 can be additionally fixed by spot welding.

Finally, FIG. 3 shows a side view of a valve tappet 1 of FIG. 1 prior to roller-forming. In the cylindrical jacket 2 of the valve tappet, there is made an axial slot 21 by punching which, due to a widening 50, has a T-shaped contour. On subsequent roller-forming, the horizontal section of this T-shaped axial slot 21 assures that, despite the deformation of the jacket in this region, oil transfer from the circumferential groove 18 into the axial slot 21 is guaranteed.

Various modifications of the valve tappet of the invention may be made without departing from the spirit or scope thereof and it is to be understood that the invention is intended to be limited only as defined in the appended claims.

What I claim is:

1. A cup-shaped valve tappet (1,25) for actuating a valve of an internal combustion engine, comprising a cylindrical jacket (2,26) closed at one end by a bottom (3,27) and on whose outer peripheral surface (17,43) a circumferential groove (18,44) is formed by non-cutting shaping, while on an inner peripheral surface (5,37) of said cylindrical jacket a sheet metal cylinder (4,39) is guided substantially without play, said valve tappet further comprising a guide sleeve (7,35) in which a hydraulic clearance compensation element (8,34) is received, characterized in that the sheet metal cylinder (4,39) extends at least up to a region of the jacket (2,26) comprising the circumferential groove (18,44) while a bead (19,46) formed by non-cutting shaping on the inner peripheral surface (5,37) of the jacket (2,26) bears against a circumferential groove (20,48) of the sheet metal cylinder (4,39).

2. A cup-shaped valve tappet (1,25) of claim 1 wherein the circumferential groove (18,44) of the cylindrical jacket (2,26) and the circumferential groove (20,48) of the sheet metal cylinder (4,39) can be made in a common roller-forming operation.

3. A cup-shaped valve tappet (1,25) of claim 1 wherein the sheet metal cylinder (4,39) comprises the circumferential groove (20,48) into which the cylindrical jacket (2,26) can be made to engage by appropriate deformation.

4. A cup-shaped valve tappet of claim 1 wherein the sheet metal cylinder (4,39) is made as a common component with a radially inwards extending flange (6,38) and with the guide sleeve (7,35) with which this flange (6,38) merges and which is concentric with the cylindrical jacket (2,26) wherein the sheet metal cylinder (4) extends at least sectionwise up to the bottom (3), and the flange (6) delimits, together with the bottom (3) and an inner piston (9) and an outer piston (11) of the clearance compensation element (8), an annular oil reservoir (15).

5. A cup-shaped valve tappet of claim 4 wherein the flange (6) is shaped as a truncated cone.

6. A cup-shaped valve tappet (25) of claim 1 in which at least one bead (40) in the sheet metal cylinder (39) extends in the longitudinal direction thereof and forms, together with the inner peripheral surface (37) of the jacket (26), an oil duct (41) which communicates with a radial oil supply bore (49) of the jacket (26) wherein the oil supply bore (49) is arranged in the circumferential groove (44) of the jacket (26) and the bead (40) extends into the circumferential groove (48) of the sheet metal cylinder (39).

7. A cup-shaped valve tappet of claim 1 wherein a wall-thickness ratio between cylindrical jacket (2,26) and the bottom (3,27) is approximately in a range of 1:2.5 to 1:2.8.

8. A cup-shaped valve tappet of claim 1 wherein the cylindrical jacket (2,26) has a wall thickness of less than 1 mm.

9. A cup-shaped valve tappet of claim 8 wherein the wall thickness is about 0.8 mm.

10. A cup-shaped valve tappet (1) of claim 1 having an axial slot (21) which is punched into the cylindrical jacket (2) and starts from the circumferential groove (18) wherein the axial slot (21), punched out prior to roller-forming, comprises a widening (50) in a peripheral direction in a region of the circumferential groove (18) and said axial slot (21) extends up to an oil canal

(24) formed by a bead (23) in the sheet metal cylinder (4).

11. A cup-shaped valve tappet of claim 10 wherein the axial slot (21) has a T-shaped contour prior to roller-forming.

12. A cup-shaped valve tappet (1) of claim 6 wherein an upper region of a roller-formed portion of the jacket (26) and of the sheet metal cylinder (39) has a flat transition or large transition radius so that communication is established between the oil supply bore (49) and the-oil duct (41).

13. A cup-shaped valve tappet of claim 1 wherein the sheet metal cylinder (39) is additionally fixed at at least one point of its lower end by a swaging (51), and a portion of the sheet metal cylinder (39) deformed by roller-forming bears in a longitudinal direction preferably against the bead (46) on one side and against the swaging (51)on an opposite side.

* * * * *